United States Patent [19]

Bianco

[11] Patent Number: 4,641,463

[45] Date of Patent: Feb. 10, 1987

[54] KEY DEBURRING AND POLISHING ASSEMBLY

[76] Inventor: Eric L. Bianco, 448 W. Second Ave., Roselle, N.J. 07203

[21] Appl. No.: 714,983

[22] Filed: Mar. 22, 1985

[51] Int. Cl.[4] ..... B24B 31/02

[52] U.S. Cl. ..... 51/7; 51/17; 15/305

[58] Field of Search ..... 51/7, 6, 412, 19, 17, 51/163.1, 164.1, 313, 314; 15/95, 96, 305

[56] References Cited

U.S. PATENT DOCUMENTS

| | | | |
|---|---|---|---|
| 1,717,554 | 6/1929 | Fraser | 51/181 NT |
| 2,924,914 | 2/1960 | Garwood | 51/19 |
| 3,568,477 | 3/1971 | Dixon | 15/305 |

FOREIGN PATENT DOCUMENTS

| | | | |
|---|---|---|---|
| 0823101 | 11/1959 | United Kingdom | 51/314 |

*Primary Examiner*—Frederick R. Schmidt
*Assistant Examiner*—Robert A. Rose
*Attorney, Agent, or Firm*—Daniel H. Bobis

[57] ABSTRACT

A key deburring and polishing assembly for keys which have been cut on a key machine or for other metal elements which have uneven or hanging pieces remaining thereon has a frame having a base member and a front end plate and a back end plate connected on opposite ends of the base member and a cover which encloses the frame, driving mechanism mounted in the frame and fixedly connected to a cylindrical drum for rotating the same which drum defines a deburring and polishing chamber open at one end and can be aligned for operative association with the inner face of the front end wall so that abrading material which can be charged into the deburring and polishing chamber of the cylindrical drum by a suitable charging opening will not escape therefrom but with sufficient clearance to permit small particles to escape. The front end plate has an opening to permit a key or other element to be inserted and so positioned that when the cylindrical drum is rotated the inserted end of the key or other device will lie in the path of the rotating abrading material and thus enable the abrading material to deburr and polish the inserted end of the key or other element.

Additionally, the combination of a key deburring and polishing assembly as above described with a key making machine for driving the deburring and polishing assembly a jackshaft assembly on the key making machine.

15 Claims, 15 Drawing Figures

KEY DEBURRING AND POLISHING ASSEMBLY

BACKGROUND OF THE INVENTION

This invention relates generally to key making machines and more particularly to an appliance adapted to debur and polish the bow of a freshly cut key.

The cutting of keys on conventional key cutting equipment is an old and well established art. However, it has been a continuous problem in the cutting of such keys that the bow portion of the key which is cut will be unfinished in that it will have burrs or rough edges. If these burrs or rough edges are not removed they can cause the key to fail during use or alternatively can damage the internal parts of the associated locks operated by these keys.

As a result various devices have been developed to overcome this problem such as hand files or for example rotating steel or glass brushes against which the keys can be manually pressed to remove the burrs and to polish the unfinished surfaces of the cut key as is shown in U.S. Pat. No. 3,902,382.

However these prior art devices have problems. Hand filing removes metal and must therefore be carefully utilized to avoid changing the profile of the cut key. The rotating steel or fiber glass brushes wear rapidly and pose a danger to the operator or bystander due to loose bristles or fibers which can be thrown randomly in any direction by reason of the centrifugal forces during the rotation of such brushes.

In a busy key cutting shop these brushes can wear out at the rate of at least one per week.

The present invention covers an improved key deburring and polishing assembly in which a rotatable container is filled with cutting pellets such as Type 100 Nylon Pellets which are rotated in the container at relatively high speed so that when the bow of a key is inserted into the rotating pellets it will be subjected to sufficient forces and bombardment by the pellets to remove burrs and to polish the surface of the key without the extensive removal of metal or change in the finish of the key.

SUMMARY OF THE INVENTION

Thus, the present invention covers an improved key deburring and polishing assembly which includes, a frame, a driving means having a rotatable shaft, a cylindrical container defining a deburring and polishing chamber, the cylinder has means at one end for connecting the container to the rotatable shaft for rotation therewith on operation of the driving means, and will be open at the end remote therefrom, abrading material is disposed in the deburring and polishing chamber of said cylindrical container and an end wall on said frame spaced for operative association with the open end of the cylindrical container prevents said abrading material from escaping said operatively associated end wall has, a predetermined sized and spaced opening extending therethrough to provide means for inserting a key into contact with the abrading material in the cylindrical container when the container is rotated by the driving means.

Additionally, the present invention covers the combination of a key making machine having a jackshaft extending from one side thereof, and a key deburring and polishing assembly connected to and rotatable with said jackshaft including, a frame, a cylindrical container defining a deburring and polishing chamber connected for rotation at one end with said jackshaft and open at the end remote therefrom, abrading material disposed in the deburring and polishing chamber of said cylindrical container, an end wall on said frame disposed for operative association with the open end of the cylindrical container to prevent said abrading material from escaping therefrom, and said end wall has a predetermined size and shaped opening extending therethrough to permit a key to be inserted for contact with the abrading material in the cylindrical container when the container is rotated by the key making machine.

Additionally, key deburring and polishing assemblies and combinations as above described including means for charging agrading material into the cylindrical container as may be required from time to time.

OBJECTS AND ADVANTAGES

Accordingly it is an object of the present invention to provide an improved key deburring and polishing assembly as an integral or self-contained unit.

It is another object of the present invention to provide a key deburring and polishing assembly which can be disposed for attachment to a jackshaft on key making machinery to provide means for deburring and polishing keys made on said key making machinery.

It is another object of the present invention to provide a key deburring and polishing assembly which includes, a rotatable container having abrading material therein operatively associated with an end wall to prevent said abrading material from escaping therefrom during the use of said key deburring and polishing assembly.

It is another object of the present invention to provide a key deburring and polishing assembly wherein a rotatable container containing abrading material can be operatively associated with the bow of a freshly cut key to debur and polish the same.

With these and other objects the invention will be better understood with respect to the illustrated embodiment and the description of the drawings as follows.

DESCRIPTION OF THE PREFERRED EMBODIMENTS OF THE INVENTION

Figure 1:
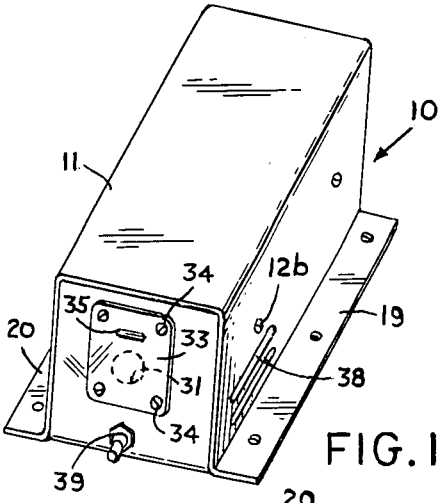
FIG. 1 is a perspective view of an integral or self-contained key deburring and polishing assembly in accordance with the present invention.
Figure 2:
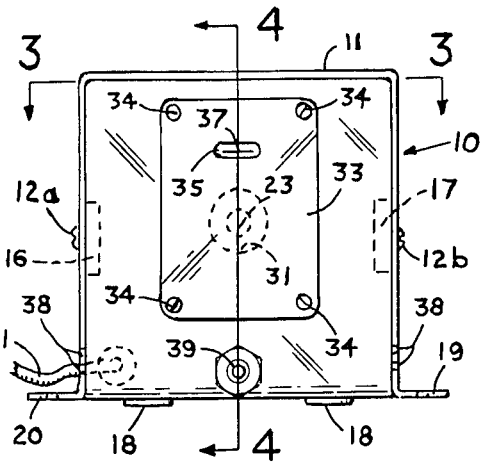
FIG. 2 is a front end view of the key deburring and polishing assembly shown in FIG. 1.

Referring to the drawings FIGS. 1 to 8 show a self-contained form of the key deburring and polishing assembly generally designated 10 in accordance with the present invention.

Figure 3:
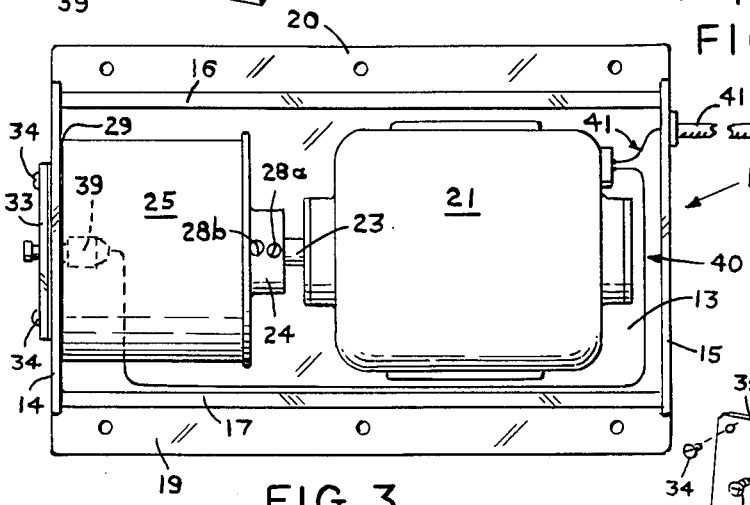
FIG. 3 is a top view of the key deburring and polishing assembly taken on line 3—3 of FIG. 1 with the outer cover removed.
Figure 5:
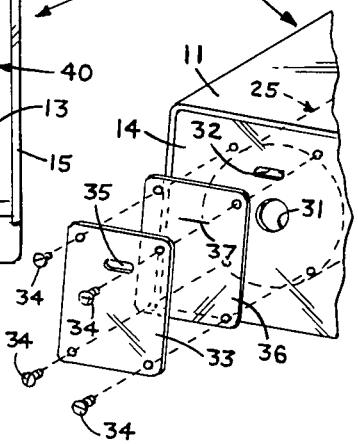
FIG. 5 is an exploded view of a fragment of the front end of the key deburring and polishing assembly shown in FIGS. 1 to 4 of the drawings.
Figure 4:
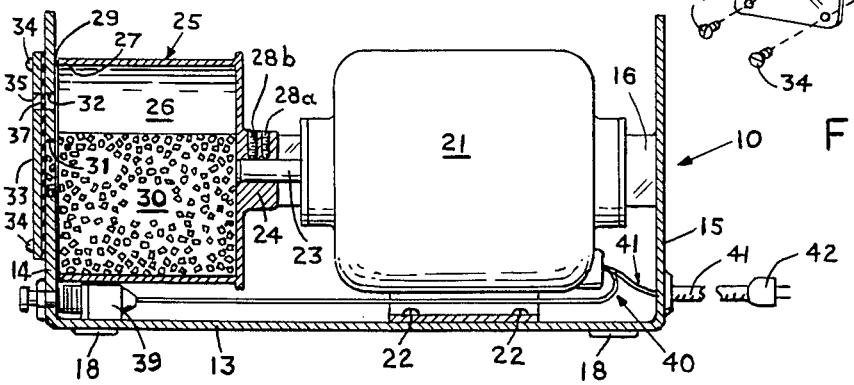
FIG. 4 is a vertical section taken on line 4—4 of FIG. 2 with the key deburring and polishing assembly in the non-operating position.

The key deburring and polishing assembly 10 includes a safety cover 11 which is removably connected as by threaded members 12*a* and 12*b* to the inner frame of the key deburring and polishing assembly 10. When the cover is removed, the inner frame as shown in FIGS. 3 and 4 has a base plate 13, front end plate 14 and back end plate 15 which are connected at their lower ends to the respective opposite ends of the base plate 13. Side braces as at 16 and 17 act to hold the front end plate 14 and back end plate 15 generally normal to the base plate 13.

FIGS. 1, 2, 3 and 4 further show that the base plate 13 is provided with spaced protective buttons on its lower face as at 18 and side flanges as at 19 and 20 which permit the key deburring and polishing assembly to be placed on a surface or to be affixed as by threaded members, not shown, to the top or to the underside of the top of a work bench or other point of use for the assembly 10.

A suitable driving means such as an electric motor 21 is mounted on the base plate by means of threaded members 22 adjacent or inwardly of the back end plate 15 so that the drive shaft 23 which rotates when the motor is in operation is disposed to extend towards the front end plate 14 as is clearly shown in FIGS. 3 and 4 of the drawings.

The electric motor 21 may be any type of conventional motor which operates at approximately 7,000 RPM which motors are easily purchaseable on the open market. The motor is connected into an electric circuit generally designated 40, which includes a suitable line as at 41 and plug 42 for connecting the electirc circuit 40 into any suitable source of electric current for driving the electric motor.

As is further shown in FIGS. 3 and 4 the drive shaft 23 is connected by a suitable coupling means as at 24 to a key deburring and polishing drum 25 which defines a key deburring and polishing chamber 26 therein.

The key deburring and polishing drum 25 is a generally cylindrical cup-shaped hollow container which is closed at the end having the connecting coupling 24 thereon and which forms an open or mouth end 27 for the key deburring and polishing chamber remote from the connecting coupling 24.

The connecting coupling 24 is shown as having at least two spaced threaded members 28*a* and 28*b* to fixedly connect the key deburring and polishing drum 25 to the rotatable drive shaft 23. These threaded members 28*a* and 28*b* are adjustable and also serves to align the transverse and longitudinal axis of the key deburring and polishing drum 25 and to hold the drum 25 in assembled position so as to reduce excessive eccentricity during rotation of the key deburring and polishing drum 25 during operation of the electric motor 21 at speeds of 7000 RPM and to maintain the end 29 of the key deburring and polishing drum 25 from frictional engagement with the inner face of the front end plate.

Figure 6:
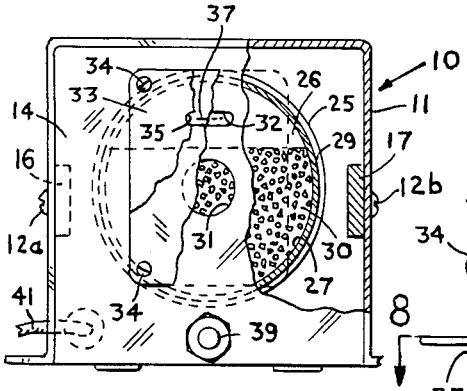
FIG. 6 is a front end view partly broken open to show the safety cover on the front end plate, the key inserting opening extending therethrough and through the front end plate, and the filling opening for the key deburring and polishing chamber in the rotatable cylindrical container.
Figure 7:
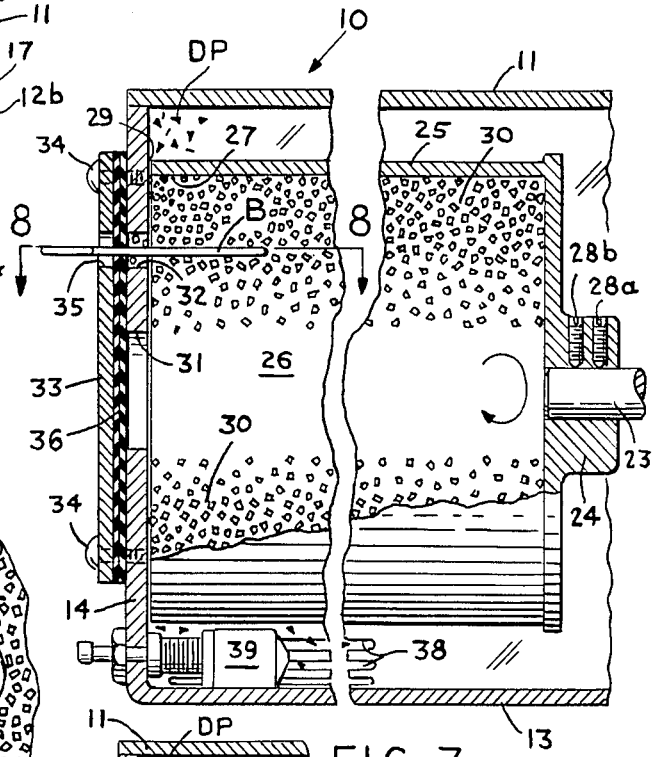
FIG. 7 is an enlarged vertical section of the front end plate section of the key deburring and polishing assembly shown in FIGS. 1 to 4 illustrating the cylindrical container during rotation with a key inserted through the front end plate for contact with the rotating abrasive material.

It is imperative as shown in FIGS. 4, 6 and 7 that the annular end 29 of the key deburring and polishing drum 25 disposed about the mouth 27 of the key deburring and polishing chamber operate with as little eccentricity as possible because the end 29 and mouth 27 of the key deburring and polishing drum 25 must be positioned for operative association with the inner face of the front end plate 14 for reasons that will appear clear from the further description below.

In order to provide effective operation of the key deburring and polishing assembly in accordance with the present invention, a mechanism is provided for both removing the burrs and for polishing the bow of a newly cut key without removing an excessive amount of material from the bow of the key. Additionally, means must also be provided for bringing the bow of the key into operative engagement with the mechanism for deburring and polishing.

Thus, referring to FIGS. 4 to 8 of the drawings the key deburring and polishing drum 24 is shown with the key deburring and polishing chamber or space 26 filled with a plurality of sized abrasive pellets generally designated 30 which are filled through the filling opening 31 in front plate 14 to within approximately ½" of the open or mouth end 27 of the key deburring and polishing chamber 26.

Various types of abrasive pellets or sized and shaped materials may be used to accomplish the desired result of deburring and polishing in accordance with the present invention. For example, aluminum oxide pellets, silicone carbine pellets, carborundom pellets, and nylon pellets may be utilized for this purpose.

However, the preferred abrasive material is nylon pellets idnetified as—Type 100 Nylon Pellets—which are sold in fifty pound bags on the open market by the Ashland Oil Corp. of Ashland, Ky. These nylon pellets are well known for use in injection molding processes in the plastic field. Such pellets will have an uneven shape and are generally non-uniform. Thus, when the key deburring and polishing drum 25 is rotated by the drive shaft 23 the nylon pellets will abrade the bow of a key which is inserted into the path of these rotating pellets thus removing the burrs and polishing the keys. These pellets become more effective with use, this may be due to the rouding of the corners on the non-uniform sized and shaped pellets.

Additionally, in order to prevent the abrasive material from escaping through the mouth 27 of the key deburring and polishing chamber, the key deburring and polishing drum is so disposed relative the inner face of the front end plate that there will be a limited clearance between the annular end 29 of the key deburring and polishing drum and the inner face of the front end plate 14 as is clearly shown in FIGS. 4, 6 and 7 of the drawings.

Further, the front end plate 14 is provided with a slot or orifice 32 therethrough which is sufficiently large to permit the bow end B of a key to be inserted through the front end plate into predetermined operative position in the key deburring an polishing chamber. Therefor, when the key deburring and polishing drum is rotated the key will lie in the path of the abrasive material rotating with the key deburring and polishing drum in an approximate position nearer to the inner wall of the key deburring and polishing chamber then to the longitudinal centerline about which the key deburring and polishing assembly will rotate, as is clearly shown in FIG. 7 of the drawings.

Figure 8:
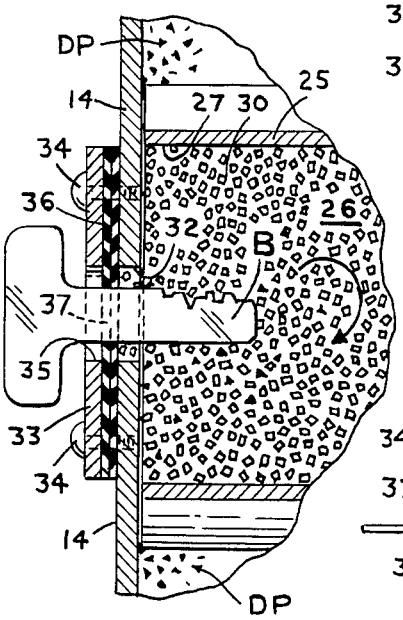
FIG. 8 is a horizontal section taken on line 8—8 of FIG. 7.
Figure 9:
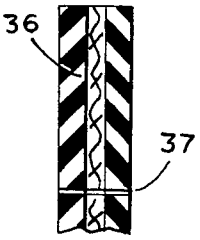
FIG. 9 is an enlarged fragmentary view of the elastomeric shield.

FIGS. 4, 5, 6 and 7 further show that the slot 32 is generally disposed parallel to the axis of rotation so that the bow end of the key when inserted into the key deburring and polishing chamber 26 will be approximately within $\frac{3}{8}''$ to $\frac{1}{2}''$ inwardly of the inner wall of the key deburring and polishing drum 25 and will so lie in the path of the abrasive material in the key deburring and polishing chamber that the abrasive material will flow against and about the newly cut portion of the bow thereby permitting the abrasive material to remove the burrs and polish the bow portion of the key without removing excessive amounts of metal during the deburring and polishing process, as is clearly shown by FIGS. 7 and 8 of the drawings.

In order to protect the operator of the self-contained key deburring and polishing assembly 10, a safety cover 33 is affixed by threaded members 34 and has an enlarged mating slot 35 which is in alignment with the slot or opening 32 in the front plate. Between the safety cover 33 and the exterior surface of the front end plate 14 an elastomeric shield 36 with a matching opening as at 37 is provided so that when a key is inserted through the aligned slot 35, 37 and 32 to deburr and polish the bow end of the key the operator will be protected and the key will simultaneously be set in the optimum position for the deburring and polishing operation of the key deburring and polishing assembly 10.

The front end plate will be sized larger than the diameter of the key deburring an polishing drum 25 and the safety cover 33 and elastomeric shield 36 will also be sized not only to permit alignment of the enlarged mating slot 35 with the slots 37 and 32 but will also cover the filling opening 31 all of which is clearly shown in FIGS. 1, 2, 4, 5, 6 and 7 of the drawings.

The clearance between the annular end 29 of the key deburring and polishing drum 25 and the inner face of the front end plate 14 will be such that it will prevent the escape of the abrasive material but will permit the waste dirt particles DP such as the materials removed during the deburring and polishing operation to escape through this clearance. The outer cover 11 will be provided with louvers as at 38 on opposite sides of the key deburring and polishing assembly 10 so that during the rotation of the key deburring and polishing drum 25 the air pressures which inherently develop will automatically drive the waste dust particles from the inside of the cover element 11 to the exterior of the key deburring and polishing assembly 10.

In order to place the key deburring and polishing assembly into operation a switch 39 is mounted on the front end plate 14 adjacent to the point where the bow of the key will be inserted through the enlarged slot 35 so that it will be relatively easy for the user of the key deburring and polishing assembly to turn on the motor. Switch 39 controls the flow of electrical current through the electrical circuit which includes, the switch 39, the motor 21, the lines 41 and 42 which connect the electrical circuit to a suitable source of power or current for operating the motor.

The switch 39 will be of the push button or intermittent type which can be operated by manual pressure to actuate the motor 21 and which will terminate flow of current to the motor, when released.

OPERATION

The user will first press the switch 39 to actuate the motor 21 to rotate the drive shaft 23. Drive shaft 23 will in turn through the coupling 24 cause the key deburring and polishing drum 25 and the abrasing material 30 thereon to rotate with the drive shaft 23 at the operating speed of the motor 21.

The newly cut key will be grasped manually and the bow end B thereof inserted through the slot 35 and the aligned slots 37 and 32 into the abrasive material 30 in the key deburring and polishing chamber 26.

As the key deburring and polishing drum 25 operates it will cause the abrasive material in the key deburring and polishing chamber to move under centrifugal force into engagement with the inner wall of the key deburring and polishing chamber where under the rotary forces acting the abrasive material will pass over, around and against the bow end 13 of the key in a lamine flow to thereby deburr and polish the said bow end B of the key as is clearly shown in FIGS. 7 and 8 of the drawings.

The rotation of the key deburring and polishing drum will be maintained for approximately two to six seconds. Thereafter the switch 39 will be released and the rotation of the key deburring and polishing drum will terminate. The key is then withdrawn from the aligned slots 35, 37 and 32 an examined to be certain that all of the burrs have been removed and the bow end of the key properly polished so as to avoid the problems of malfunction with the mating lock which occurs if the key is not properly deburred and polished, as will be understood by those skilled in the art.

MODIFIED FRONT END PLATE

Figure 10:
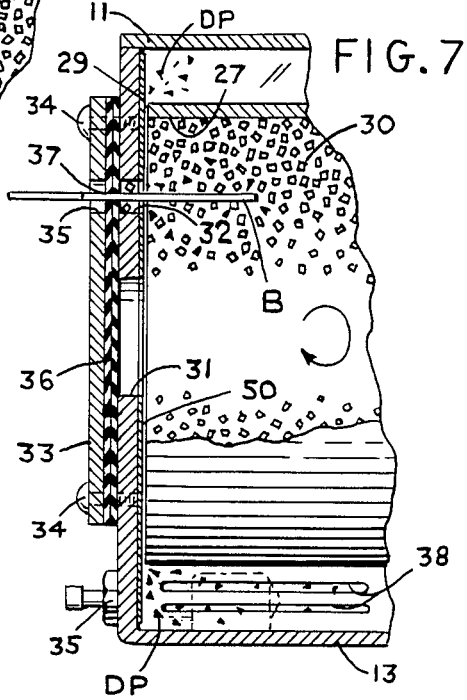
FIG. 10 is a partial enlarged vertical section of the front end of the key deburring and polishing assembly similar to FIG. 8 showing a modified form of a front end plate having an aluminum oxide coating on the inner face adjacent the open end of rotating cylindrical container.

While the self-contained key deburring and polishing assembly 10 above described has suggested the use of Type 100 Nylon Pellets those skilled in the art will readily recognize that more abrasive materials can be used for not only deburring and polishing keys but also other elements of freshly cut metals. Therefore where such stronger abrasive materials such as aluminum oxide pellets, silicone carbine pellets or carborundum pellets are utilized as a further protection to avoid frictional engagement and/or wear on the front end plate, the front end plate can be modified to provide a suitable coating thereon of aluminum oxide 50 as is shown in FIG. 10 of the drawing.

The structure and operation with this modified front end plate will be otherwise identical with that as above described for the self-contained form of the invention shown in FIGS. 1 to 8 of the drawings.

ATTACHMENT TO A KEY MAKING MACHINE

FIGS. 11 to 15 show an alternate embodiment of the invention in the form of an attachment to the jackshaft end of a key making machine for small key making shops. As was indicated above, the prior art shows that the jackshaft end of the key making machine can have a steel or a fiberglass brush connected thereon which can be utilized to deburr and polish the bow end of a newly cut key. This conventional and well known practice is for example shown in U.S. Pat. No. 3,902,382. The present invention also can be modified for attachment to the jackshaft end of a key making machine.

Thus, by reference to FIGS. 11 to 15 a generally U-shaped frame 111 is shown having spaced end plates as at 112 and 113. End plate 113 is provided with a suitable opening as at 114 to permit the U-shaped frame 111 to be mounted about the jackshaft 115 and connected to the adjacent end of the key mounted casing 116 as by threaded members 117.

Figure 11:
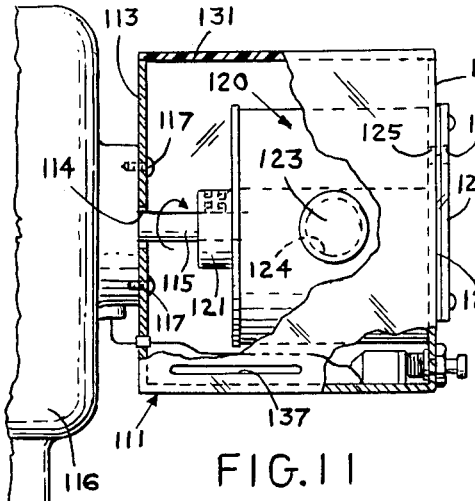
FIG. 11 is a view of a key deburring and polishing attachment on a jackshaft from a key making machine.
Figure 12:
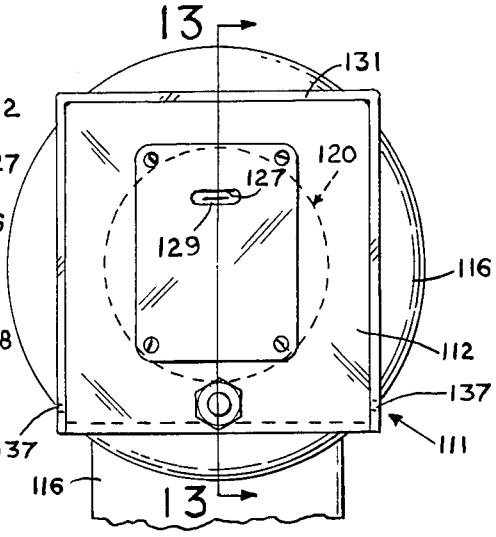
FIG. 12 is a front end view of the key deburring and polishing attachment shown in FIG. 10.
Figure 13:
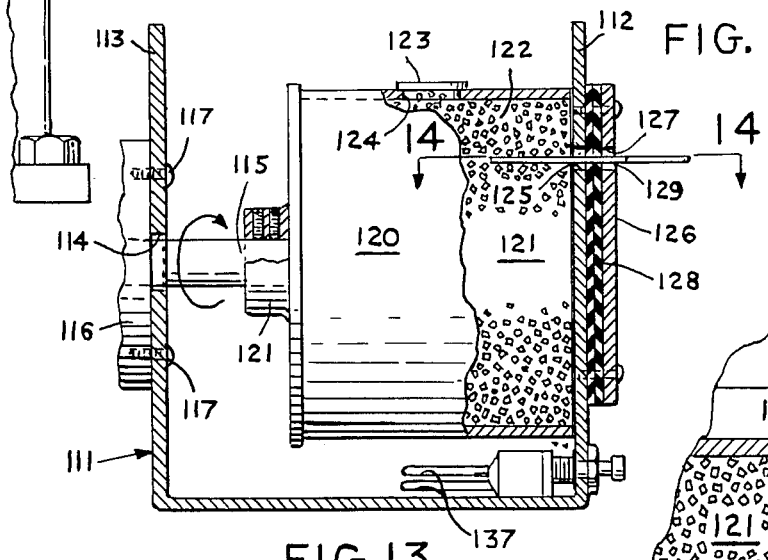
FIG. 13 is a vertical section taken on line 13—13 of FIG. 12.
Figure 15:
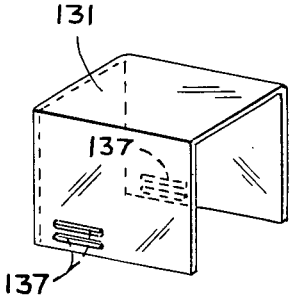
FIG. 15 is a perspective view of the plastic transparent safety cover for the key deburring and polishing attachment shown in FIG. 11.
Figure 14:
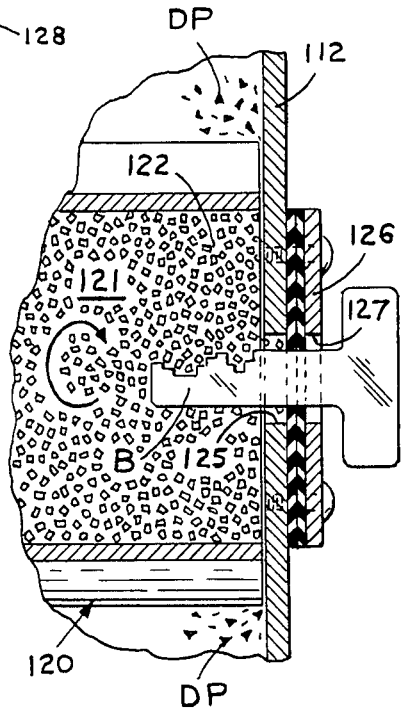
FIG. 14 is a horizontal section taken on line 14—14 of FIG. 13.

A suitable sized key deburring and polishing drum 120 will have a connecting coupling 121 for connecting the key deburring and polishing drum 120 to the end of the jackshaft 115 which extends into the U-shaped frame 111 in assembled position as is shown in FIGS. 11 and 13 of the drawings.

The key deburring and polishing drum 120 is identical with that above described for the self-contained form of the invention except that it will be sized to fit in assembled position on the jackshaft within the U-shaped frame so as to coact with the lower face of end plate 112. Key deburring and polishing drum 120 defines the key deburring and polishing chamber 121 therein which receives the abrasive material 122 in the same manner above described for the self-contained form of the invention except that the filling of the deburring and polishing chamber 21 will be done through a side filling opening 124 in the wall of the key deburring and polishing drum 120, which is normally maintained closed by a removable filling cap 123.

The end plate will have a slot 125 over which will be provided a suitable safety cover 126 having an enlarged aligned mating slot 127 and an elastomeric shield 128 with an aligned opening 129 therethrough so that a key can be extended through the front plate into the key deburring and polishing chamber 121 in the key deburring and polishing drum 120.

A pivotally mounted safety cover 131 will be provided on the frame 111 with a suitable latch means, not shown, and louvers 137 so that the cover can be pivoted to expose the key deburring and polishing drum 120 to permit the key deburring and polishing chamber to be filled through the filling opening 124 by removing and replacing the normally closed filling cap or cover 123 therein.

OPERATION

When the jackshaft 115 of the key making machine is placed in operation it will rotate the key deburring and polishing drum 120 causing the abrasive material therein to rotate. The bow of the key to be deformed and polished is inserted through the aligned slots 127, 129 and 125 into engagement with the abrasive material and removed after five to ten seconds in the same manner as was described for the self-contained form of this invention.

Tests of the present invention as above described show that the self-contained unit is ideal for a work bench because it can be mounted on the underside of the top of the work bench. Additionally, it does not vibrate and has a built in safety factor because the moving parts are isolated from the user.

Key deburring and polishing assemblies and/or adaptors for key making machines as herein described are ideal because they require minimum hand/eye coordination and because of the built in safety factor will not injure an inexperienced operator of the machine.

Further, tests show that key deburring and polishing done on machines as herein described require but little skill and produce a smoother and more effective finish to the bow end of a freshly cut key then the known prior art devices.

While the foregoing description illustrates various preferred embodiments of apparatus and systems in accordance with the present invention, it will be appreciated that certain changes and modifications may be made in the structure of these disclosed arrangements without departing from the spirit and scope of the invention and that the same is defined by the claims as hereinafter set forth.

What is claimed is:

1. A key deburring and polishing assembly comprising, a. frame means, b. driving means in said frame means having rotatable shaft extending therefrom, c. a cylindrical drum defining a deburring and polishing chamber having, an opening at one end and means at an end remote therefrom for fixedly connecting the cylindrical container to the rotatable shaft of the driving means for rotation therewith, d. abrading material disposed in the deburring and polishing chamber of said cylindrical container, e. an end plate on said frame means disposed for spaced and operative association with the open end of the cylindrical container to prevent said abading material from escaping when the cylindrical container is being rotated, f. said end plate having, a slot therethrough to permit a key to be inserted for contact with the abrading material in the cylindrical container when the container is rotated by the driving means, and g. securing means on an outer wall of the end plate, removably securing the key within the slot and cooperating with said slot to permit a portion of said key to extend into the cylindrical drum.

2. In a key deburring and polishing assembly as claimed in claim 1 including, means for charging abrading material into the deburring and polishing chamber of said cylindrical drum as may be needed from time to time.

3. In a key deburring and polishing assembly as claimed in claim 1 including, a. electrical circuit means including means for connecting said electrical circuit means to a suitable source of power, b. switch means connected to said frame, c. said electrical circuit connecting the switch means and the driving means so the driving means can be intermittently operated on insertion of the key for deburring and polishing.

4. In a key deburring and polishing assembly as claimed in claim 1 wherein the end plate has an inner face position for operative association with the open end of the cylindrical drum to permit materials abraded from the inserted key to escape from the cylindrical drum.

5. In a key deburring and polishing assembly as claimed in claim 1 wherein, a. the means for fixedly connecting the cylindrical drum to the rotatable shaft of the driving means also acts to align the open end of the drum with respect to the end plate to prevent frictional engagement therebetween.

6. In a key deburring and polishing assembly as claimed in claim 5 wherein, a. the means for fixedly connecting the cylindrical drum to the rotatable shaft includes at least two threaded means, and b. said threaded means adjustable to provide the desired alignment of the open end of the cylindrical drum to the end plate.

7. In a key deburring and polishing assembly as claimed in claim 4 including, a. outer cover means removably connected to the frame means to cover the cylindrical drum and driving means, and b. said outer cover means having louver means in the side thereof to enable abraded material to pass out of the key deburring and polishing assembly.

8. In a key making machine having, a rotatable jackshaft, and switch means for actuating and deactuating rotation of the jackshaft, the combination with said jackshaft of;

a. frame means mounted to said key making machine to permit the jackshaft to extend into the frame means, b. a cylindrical drum, defining a deburring and polishing chamber, and having means at one end for fixedly connecting the cylindrical container to the rotatable jackshaft for relation therewith, c. abrading material disposed in the deburring and polishing chamber of said cylindrical container, d. said frame means having, an end plate with a slot extending therethrough to permit a key to be inserted for contact with the abrading material in the cylindrical container when the container is rotated by the jackshaft, and e. securing means on an outer wall of the end plate, removably securing the key within the slot and cooperating with said slot to permit a portion of said key to extend into the cylindrical drum.

9. In the combination as claimed in claim 8 including, means for charging abrading material into the deburring and polishing chamber of the cylindrical drum as may be needed from time to time.

10. In the combination as claimed in claim 8 wherein;

a. the cylindrical drum is provided with an open end remote from the end for fixedly connecting the cylindrical drum to the jackshaft, and b. the end plate is positioned for operative association with the open end of the cylindrical drum to prevent abrading material from escaping.

11. In the combination as claimed in claim 8 wherein;

a. the cylindrical drum is provided with an open end remote from the end for fixedly connecting the cylindrical drum to the jackshaft, b. the end plate has an inner face positioned for operative association with the open end of the cylindrical drum to prevent abrading material from escaping, and c. the open end of the container and the inner face of the end plate having a clearance at least sufficient to permit materials abraded from the inserted key to escape from the cylindrical drum.

12. In the combination as claimed in claim 11, including;

a. safety cover means removably connected to said frame, and b. said safety cover means has louver means in the side thereof to enable abraded material and dirt to pass out of the key deburring and polishing attachment.

13. In the combination as claimed in claim 11 wherein the inner face of the end plate is coated with hard material to prevent erosion of the inner face of the end plate.

14. In the combination as claimed in claim 8 wherein;

a. the means for fixedly connecting the cylindrical drum to the rotatable jackshaft also acts to align the open end of the drum with respect to the end plate to prevent frictional engagement therebetween.

15. In the combination as claimed in claim 14 wherein;

a. the means for fixedly connecting the cylindrical drum to the rotatable jackshaft includes, at least two threaded means, and b. said threaded means adjustable to provide the desired alignment of the open end of the cylindrical drum to the end plate.

* * * * *